US009151294B2

(12) United States Patent
Huang

(10) Patent No.: US 9,151,294 B2
(45) Date of Patent: Oct. 6, 2015

(54) FAN DEVICE WITH FLUIDIC AIR FUNCTION

(75) Inventor: Shu Li Huang, Taipei (TW)

(73) Assignee: BEL'AIR INTERNATIONAL GROUP LTD., Taipei (TW)

( * ) Notice: Subject to any disclaimer, the term of this patent is extended or adjusted under 35 U.S.C. 154(b) by 620 days.

(21) Appl. No.: 13/552,138

(22) Filed: Jul. 18, 2012

(65) Prior Publication Data

US 2014/0023495 A1 Jan. 23, 2014

(51) Int. Cl.

| | |
|---|---|
| ***F04D 19/00*** | (2006.01) |
| ***F04D 29/54*** | (2006.01) |
| ***F04D 29/70*** | (2006.01) |

(52) U.S. Cl.

CPC ..... *F04D 19/002* (2013.01); *F04D 29/542* (2013.01); *F04D 29/544* (2013.01); *F04D 29/547* (2013.01); *F04D 29/703* (2013.01); *F04D 29/705* (2013.01)

(58) Field of Classification Search

CPC ... F04D 29/542; F04D 29/544; F04D 29/547; F04D 29/703; F04D 29/705; F04D 19/002

USPC ..... 415/213.1, 214.1

See application file for complete search history.

(56) References Cited

U.S. PATENT DOCUMENTS

| | | | | |
|---|---|---|---|---|
| 2,524,390 | A * | 10/1950 | Laubach et al. | 138/39 |
| 6,749,398 | B2 * | 6/2004 | Lu et al. | 415/121.2 |
| 2002/0090308 | A1 * | 7/2002 | Cheng | 417/423.1 |
| 2002/0094271 | A1 * | 7/2002 | Yeuan et al. | 415/208.2 |
| 2009/0226299 | A1 * | 9/2009 | Jin | 415/66 |

* cited by examiner

*Primary Examiner* — Nathaniel Wiehe
*Assistant Examiner* — Woody A Lee, Jr.
(74) *Attorney, Agent, or Firm* — Rabin & Berdo, P.C.

(57) ABSTRACT

The present invention is related to a fan device with fluidic air function, wherein the fan device is configured with an air guide frame which provides each air molecule with higher space freedom and surface area existing in the space by more frequent collision and a longer fluidic path. Thus, after propelling from the fan and colliding with the air guide frame by following the swirly blades, the air flow becomes more comfortable and feels like a nature breeze when it touches human skin, and the present invention is applicable in all types of electric fan or any structure blowing the air.

4 Claims, 6 Drawing Sheets

FAN DEVICE WITH FLUIDIC AIR FUNCTION

BACKGROUND OF THE INVENTION

1. Field of the Invention

A fan device with fluidic air function, which contains a fan device and is characterized by comprising an air guide frame which is further composed of a frame body and at least two clockwise swirly blades, wherein the said frame body is configured with a plural of arc-section inclined guides which are overlapped at both sides with each other to form a whole structure of frame body with a fitting edge at the back rim position, and the at least two clockwise swirly blades are configured with the center part at one end and are connected with the inner side of the frame body by twisting the other end. With this combination, the present invention is applicable to guide the air flow with a prolonged and swirly air path in the space and provides higher air molecule freedom which enables a better indoor air circulation and forms a comfortable and nature breeze.

2. Description of Related Art

Traditionally, an electric fan is always driven by the inner motor to blow the air forward and is equipped with a protection frame to avoid touching with the rotating fan. Therefore, that electric fan only functions as a device to pump the air forward. The said protection frame is also linked with a reducing gear to make it rotatable and the air flows like a swirl.

However, the air is flowing at the front of electric fan and the protection frame is configured as a strip structure only and it could not provide a better circulation effect around the whole indoor space. Furthermore, the prior electric fan might not be able to make an indoor space full of a fresh and fragrant air or its air flow is still too strong to produce an air like natural breeze. Even the prior electric fan is equipped with a swing gear to control the electric fan swinging to and fro with certain angle coverage, there is still a limited space for circulation.

In view of these drawbacks and problems, the present invention aims to provide a fan device with fluidic air function that is applicable to an existed air blowing device to convert an air flow generated therefore into a mild and comfortable flow of air that seems to a natural breeze with an aromatic essence or perfume for indoor air refreshing purpose.

SUMMARY OF THE INVENTION

The primary objective of the present invention is to provide a fan device with fluidic air function, which contains a fan device and is characterized by comprising an air guide frame which is further composed of a frame body and at least two clockwise swirly blades, wherein the at least two clockwise swirly blades are in series configured with the center part, located inside of the frame body, at one end and are connected with the inner side of the frame body by twisting the other end to shape as a streamline air-guiding surface. Meanwhile, each of the at least two clockwise swirly blades is firmly configured with a securing ring at the back side. With such a configuration, the air guide frame is applicable to guide the air flow with a prolonged and swirly air path in the space and provides higher air molecule freedom which enables a better indoor air circulation and forms a comfortable and nature breeze.

The second objective of the present invention is to provide a fan device with fluidic air function, wherein the said frame body is configured with a plural of arc-section inclined guides which are overlapped at both sides with each other to form as a one-piece structure of frame body with a fitting edge at the back rim position.

To achieve the said objectives, the present invention provides a fan device with fluidic air function, contains a fan device and is characterized by comprising an air guide frame which is further composed of a frame body and at least two clockwise swirly blades, wherein the said frame body is configured with a plural of arc-section inclined guides which are overlapped at both sides with each other to form a whole structure of frame body with a fitting edge at the back rim position, and the at least two clockwise swirly blades are configured with the center part at one end and are connected with the inner side of the frame body by twisting the other end to form as multi streamline blades. And, all those blades are further fixed at the back side by a securing ring which is configured as a one-piece structure with the frame body. Furthermore, the present invention is also applied with an essential oil bottle which is hung by the round groove of the center rod configured with the center part.

By above-mentioned configuration, the present invention is applicable to guide the air flow propelled from the fan with a prolonged air path in the space and provides a fluidic air function which results loose air molecule has larger surface area existing in the air-flow, enables a better indoor air circulation, and generates a mild and comfortable breeze to have a better indoor air refreshing with some aromatic essence or perfume located inside the oil bottle.

The function and structure of practical embodiments can be further understood via the drawings listed below.

BRIEF DESCRIPTION OF THE DRAWINGS

The present invention can be further understood from the following drawings.

DETAILED DESCRIPTION OF THE PREFERRED EMBODIMENTS

Figure 1:
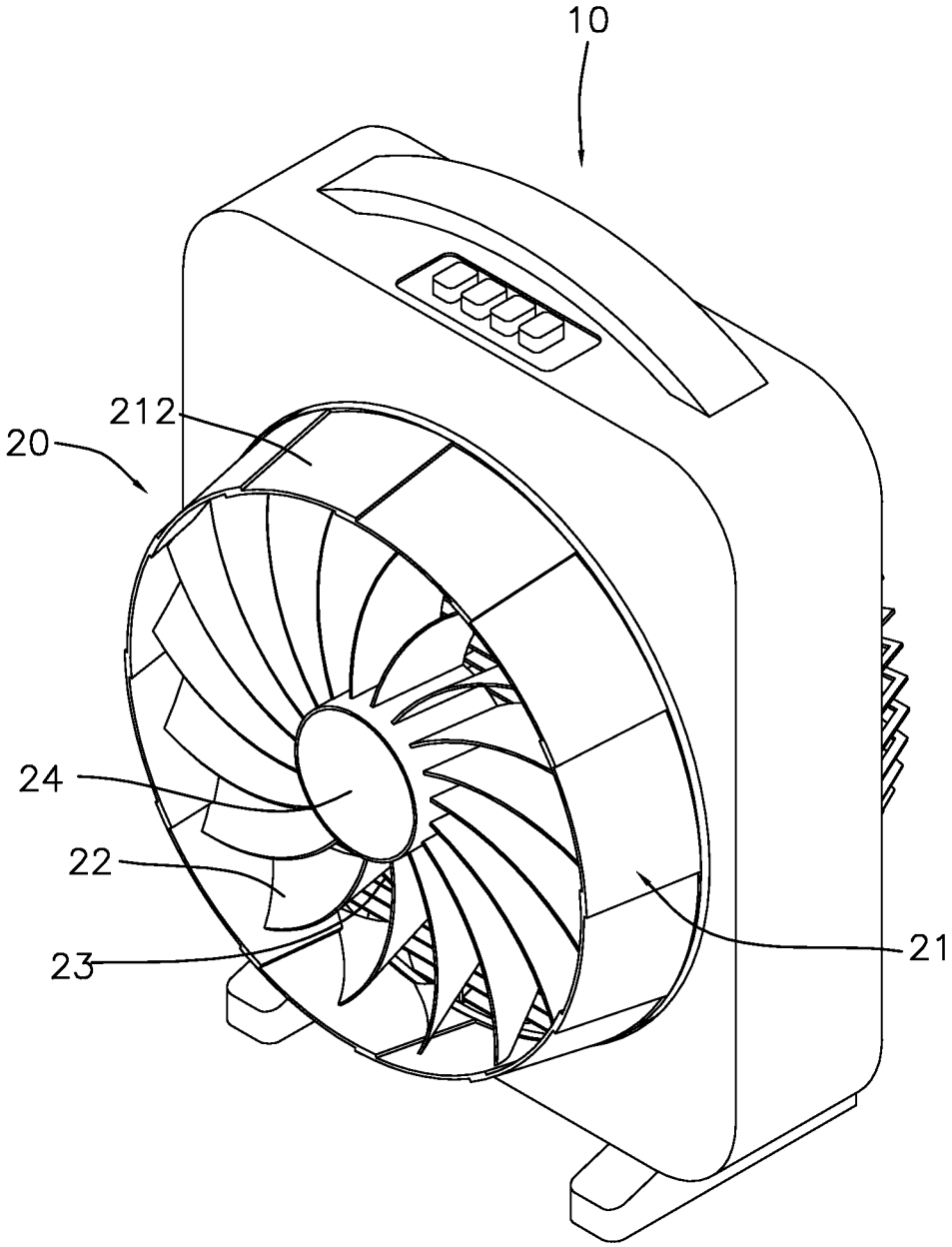
FIG. 1 is a perspective view of the present invention.
Figure 2:
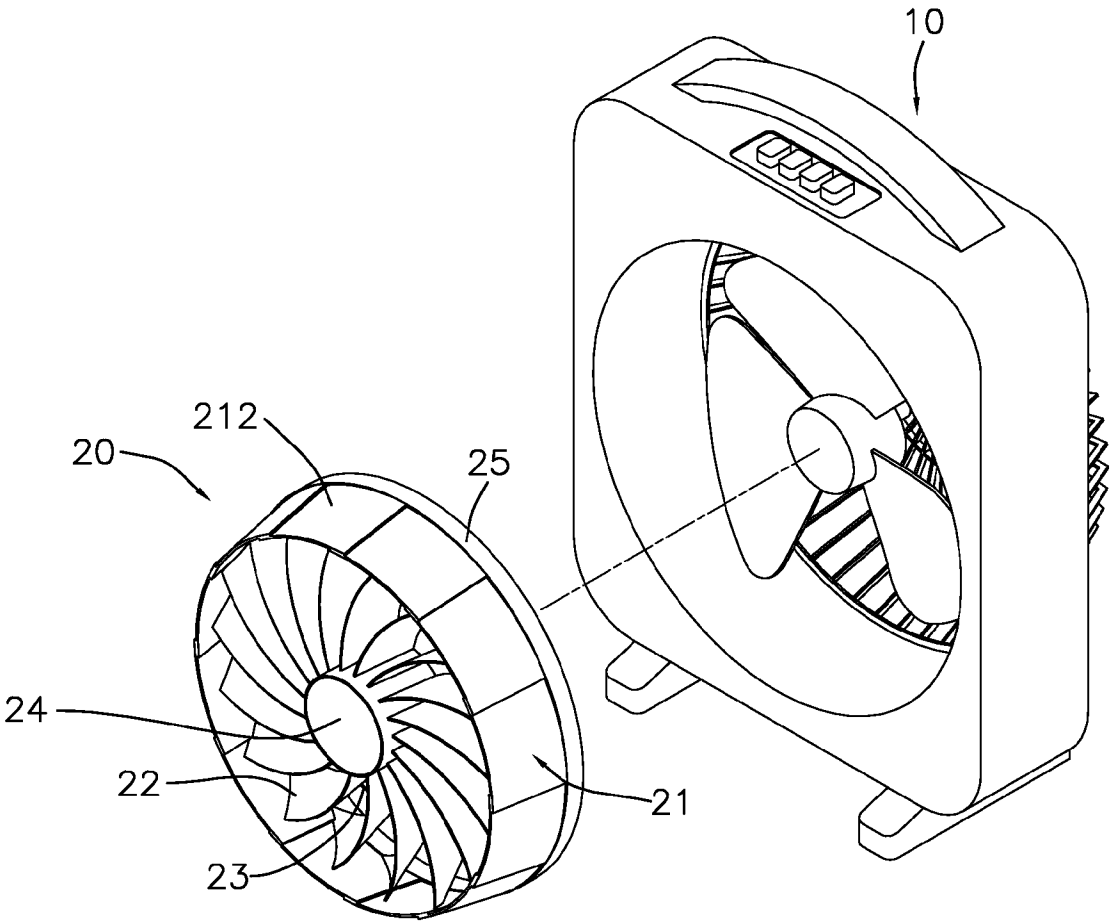
FIG. 2 is an element decomposition view of the present invention.
Figure 3:
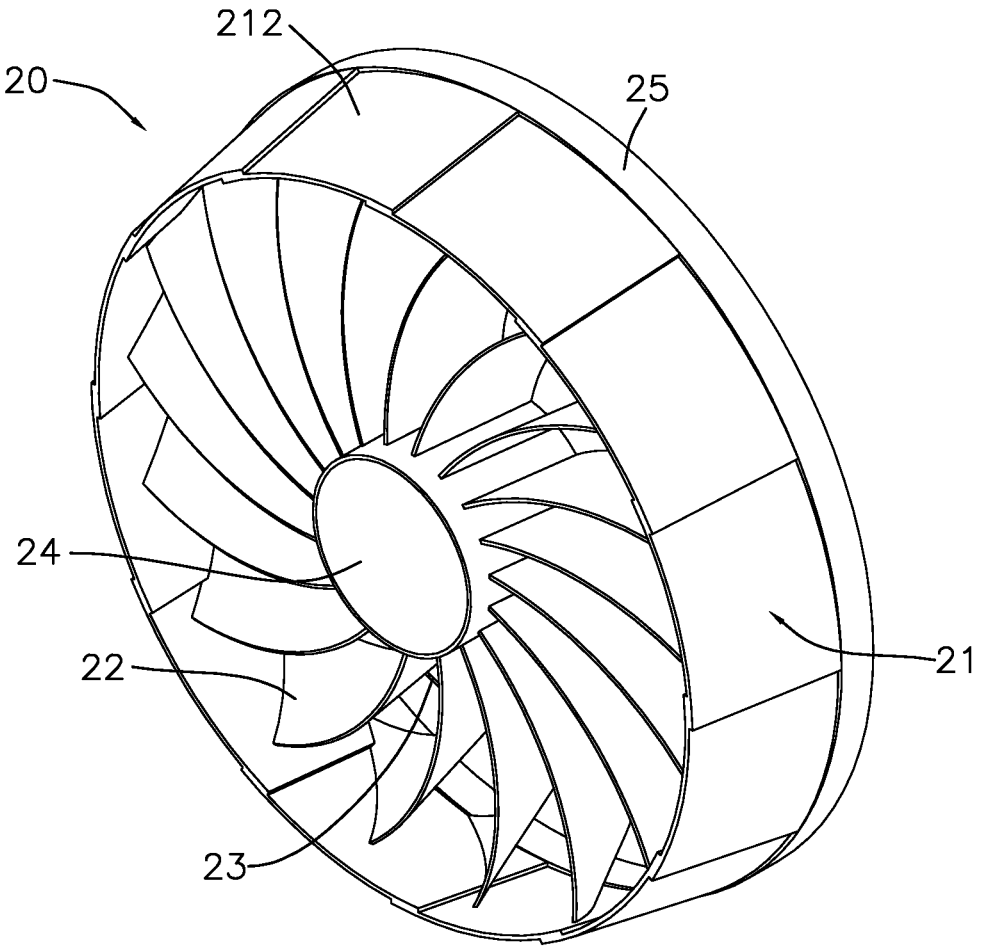
FIG. 3 is a schematic view of the frame body.
Figure 4:
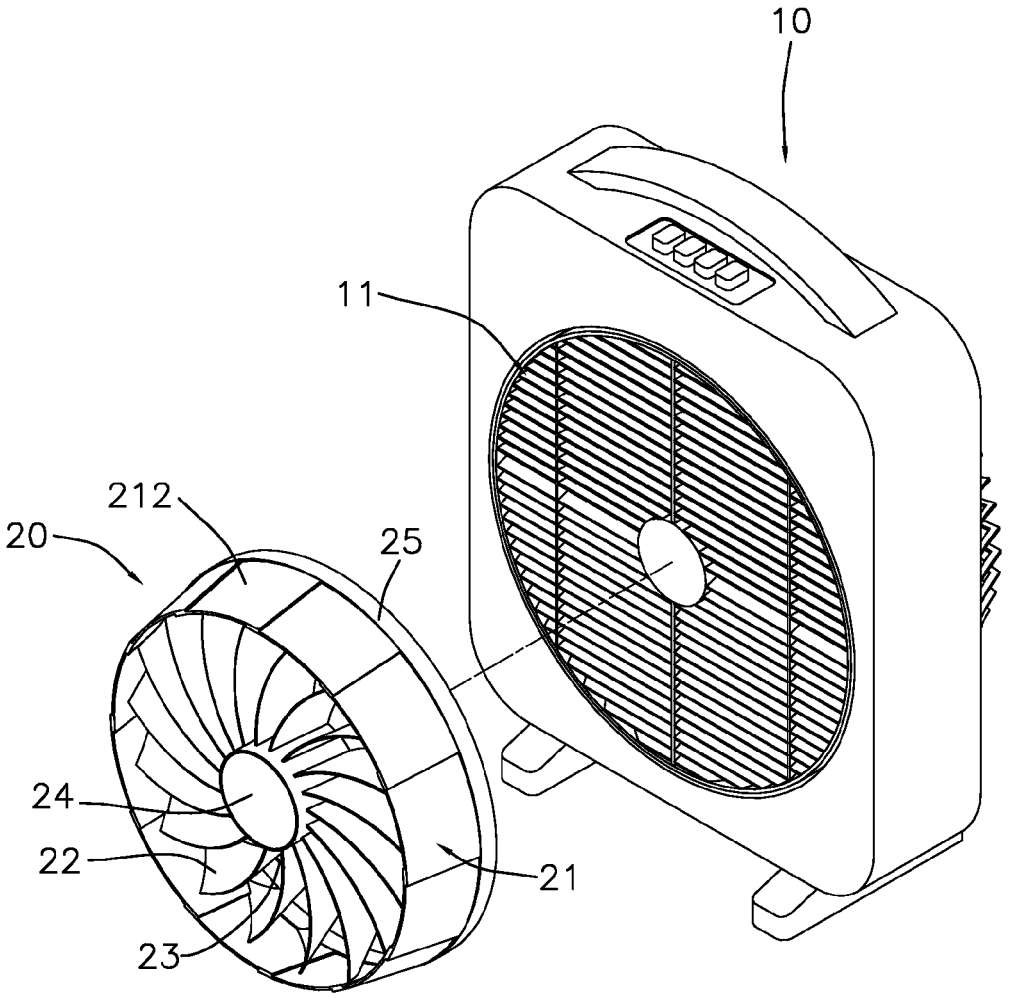
FIG. 4 shows a schematic combination with a fan device configured with a protection frame.
Figure 5:
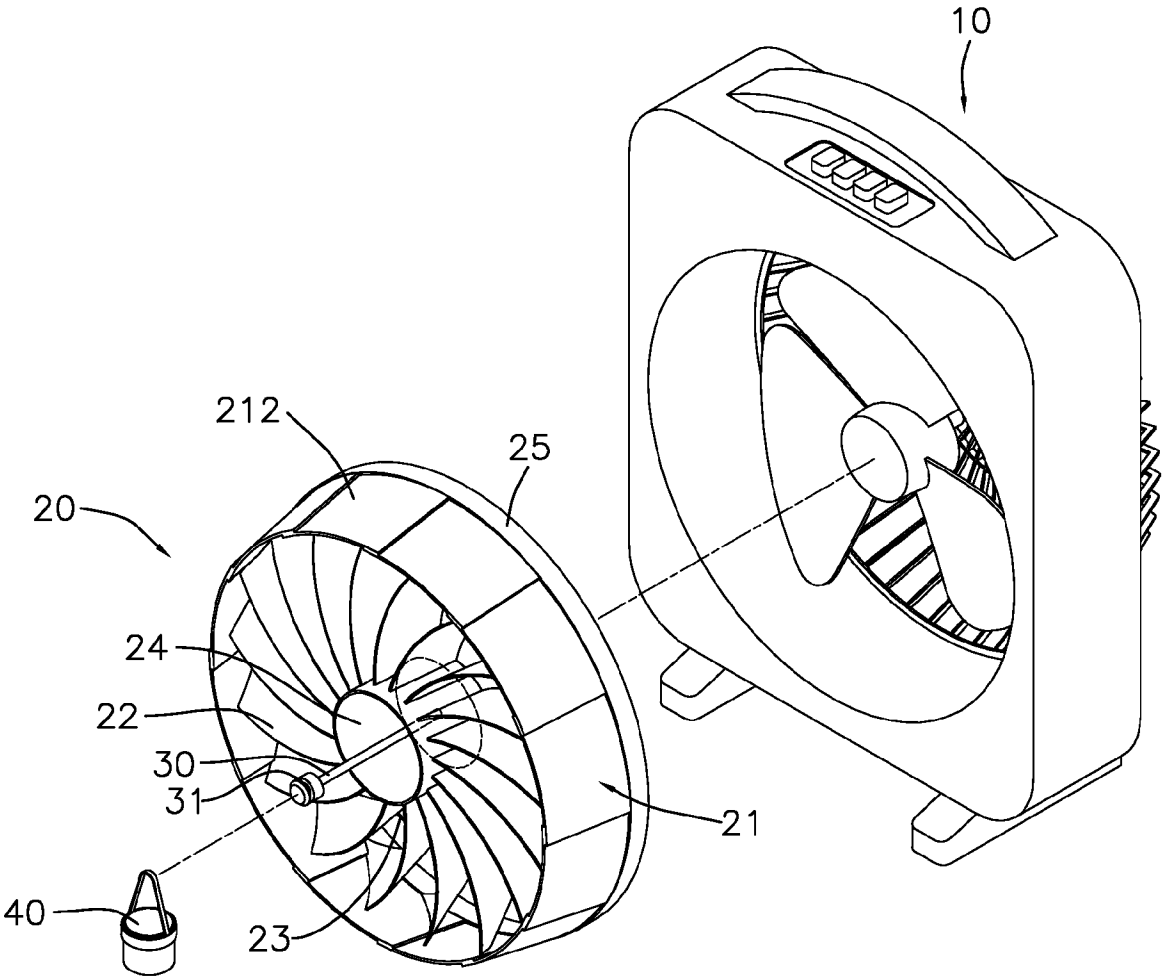
FIG. 5 shows a schematic combination with the essential oil bottle of the present invention.
Figure 6:
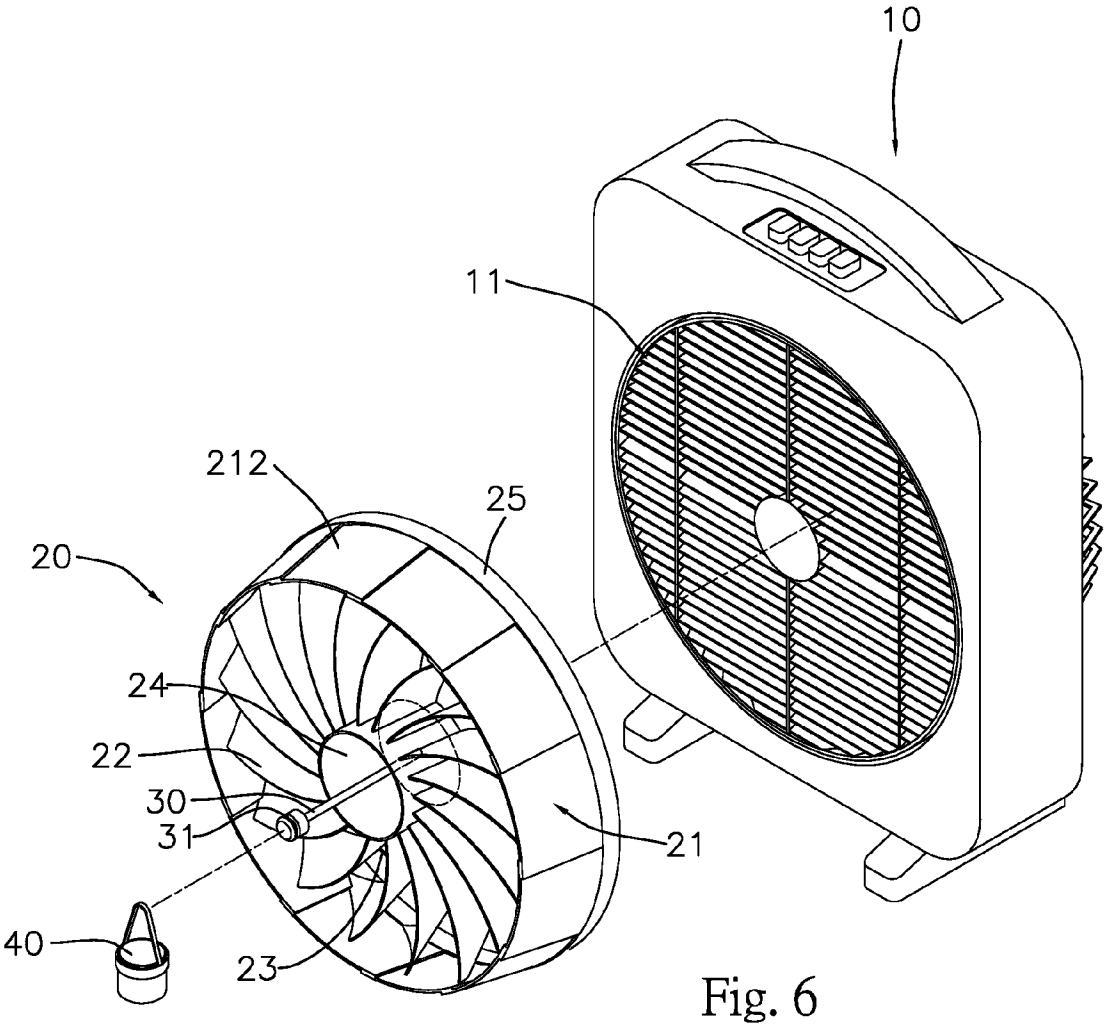
FIG. 6 shows a schematic combination with the essential oil bottle of the present invention configured with a protection frame.

With reference to the Figures from 1 to 6, the present invention relates to a fan device with fluidic air function, which contains a fan device 10 and is characterized by comprising an air guide frame 20 which is further composed of a frame body 21 and at least two clockwise swirly blades 22, wherein the at least two clockwise swirly blades 22 are in series configured with the center part 24, located at the center of the frame body 21, at one end and are configured with the inner surface of the frame body 21 by twisting the other end to shape as streamline air-guiding blades. Meanwhile, each of the at least two clockwise swirly blades 22 is firmly configured with a securing ring 23 at the back side to form as a complete one-piece structure with the air guide frame 20. As mentioned, all those at least two clockwise swirly blades 22 have an arc shape with a twisted direction toward the fan device 10 and then are configured with the inner surface of the frame body 21. With such a configuration, the air guide frame 20 is applicable to guide the air flow following the prolonged and swirly air path in the space and provides a better indoor air circulation and forms a comfortable and nature breeze.

The present invention relates to a fan device with fluidic air function, which contains a fan device 10 and is characterized by comprising an air guide frame 20 which is further composed of a frame body 21 and at least two clockwise swirly blades 22, wherein the said frame body 21 is configured with a plural of arc-section inclined guides 212 which are overlapped at both sides with each other to form as a strong round inclined structure of the frame body which guides and forces the air-flow following the swirly air path formed by the swirly blades 22 to provide higher air molecule freedom and enable a fresher indoor air circulation. There is a fitting edge 25 configured at the back rim position which could have a convenient joint assembly with the prior fan device 10 or with its protection frame 11.

Furthermore, the present invention is also applied with another embodiment which comprises a center rod 30 configured with the center part 24. The center rod 30 is formed as a round groove 31 at its front end to hang an essential oil bottle 40. Therefore, the refreshing essence can follow the swirl air-flow to spread over the indoor space with a comfortable air circulation.

The present invention relates to a fan device with fluidic air function, which is characterized by comprising an air guide frame 20 and is further composed of a frame body 21 and at least two clockwise swirly blades 22. The air guide frame 20 is alternatively applied with a prior fan device 10 or with its protection frame 11, which provides a convenient joint assembly for a newly produced fan device 10 or those prior ones. The air guide frame 20 can fit with the protection frame 11 by the fitting edge 25 configured at the back rim position and thus both rotate synchronously. The present invention also provides another embodiment which is configured with an essential oil bottle 40 and then offers an extra function which makes indoor space with a refreshing essence. Besides, the fan device 10 described in the present invention can be a circulation fan set which comprises the twin or triple (multi) circulation fans (not shown) in one configuration to form an up and down fans structure.

Of course, it is to be understood that the embodiments described herein are merely some illustrations related to the objects of the invention and that a wide variety of modifications thereto may be adopted without departing from the purpose and the scope of the present invention as set forth in the following claims.

What is claimed is:

1. A fan device with a fluidic air function, comprising:

a fan including a protection frame; and an air guide frame composed of a frame body, a fitting edge configured at a back rim position of the air guide frame, a securing ring at a back side, and at least two swirly blades that swirl in a clockwise direction when viewed from a front, wherein the frame body is configured with a plurality of arc-section inclined guides which are each overlapped at two opposite sides thereof with other arc-section inclined guides of the arc-section inclined guides to form a round inclined structure of the frame body with the fitting edge configured at the back rim position of the air guide frame, and the at least two swirly blades are in series configured with a center part, located at a center of the frame body, at one end of the at least two swirly blades, the at least two swirly blades are configured with an inner surface of the frame body by twisting another end of the at least two swirly blades toward the fan to shape the at least two swirly blades as a plurality of streamline air-guiding blades which are secured with the securing ring at the back side, and the air guide frame is jointly assembled with the protection frame by the fitting edge at the back rim position and both the air guide frame and the protection frame rotate synchronously.

2. The fan device with fluidic air function according to claim 1, wherein the fan device is a fan set which comprises multiple fans in one configuration to form an up and down fans structure.

3. A fan device with a fluidic air function, comprising:

an air guide frame composed of a frame body, a fitting edge configured at a back rim position of the air guide frame, a securing ring at a back side, and at least two swirly blades that swirl in a clockwise direction when viewed from a front, wherein the frame body is configured with a plurality of arc-section inclined guides which are each overlapped at two opposite sides thereof with other arc-section inclined guides of the arc-section inclined guides to form a round inclined structure of the frame body with the fitting edge configured at the back rim position of the air guide frame, and the at least two swirly blades are in series configured with a center part, located at a center of the frame body, at one end of the at least two swirly blades, the at least two swirly blades are configured with an inner surface of the frame body by twisting another end of the at least two swirly blades toward a fan to shape the at least two swirly blades as a plurality of streamline air-guiding blades which are secured with the securing ring at the back side, further wherein the air guide frame further comprises a center rod disposed in the center part and which is formed as a round groove at a front end of the center rod to hang an essential oil bottle.

4. The fan device with fluidic air function according to claim 3, wherein the fitting edge is configured to fit with a prior fan device or with a prior fan device protection frame.

* * * * *